US005944254A

United States Patent [19]

Liu

[11] Patent Number: 5,944,254

[45] Date of Patent: Aug. 31, 1999

[54] SAVINGS COIN BOX WITH CONTROLLABLE MUSIC BOX

[76] Inventor: Jack Liu, No. 3, Alley 202, Kao-Fon Rd., Hsin-Chu, Taiwan

[21] Appl. No.: 08/835,819

[22] Filed: Apr. 16, 1997

[51] Int. Cl.[6] ..... A47G 29/00

[52] U.S. Cl. ..... 232/4 R; 84/95.1; 446/9; 232/7; 232/1 D; 232/55

[58] Field of Search ..... 232/1 D, 7, 9, 232/55, 57, 4 R; 84/94.2, 95.1, 95.2, 97; 446/9

[56] References Cited

U.S. PATENT DOCUMENTS

| | | | |
|---|---|---|---|
| 2,531,495 | 11/1950 | Baggott | 446/9 X |
| 2,952,093 | 9/1960 | Matthay | 446/9 |
| 3,258,100 | 6/1966 | Taff | 446/9 X |
| 5,255,461 | 10/1993 | Chiou | 84/94.2 X |
| 5,304,084 | 4/1994 | Liao | 232/4 R X |
| 5,509,602 | 4/1996 | Liu | 232/7 |

*Primary Examiner*—Brian K. Green
*Assistant Examiner*—William L. Miller
*Attorney, Agent, or Firm*—Smith, Gambrell & Russell, LLP; Beveridge, DeGrandi, Weilacher & Young; Intellectual Property Group

[57] ABSTRACT

A savings coin box with controllable music box which includes a body, a music box, a control device and other elements. The music box is transversely positioned on the supporting disk on the cylindrical body, and a control device is installed above the music box. According to this structure, when a coin is thrown from a guiding rail, the extending rod of the control device is driven so that the music box will not be confined and the potential power is released. When the control disk of the control device is rotated through a predetermined angle, the music box is again limited by the extending rod, and then it is stopped.

17 Claims, 4 Drawing Sheets

SAVINGS COIN BOX WITH CONTROLLABLE MUSIC BOX

BACKGROUND OF THE INVENTION

1. Field of the Invention

The present invention is related to a savings coin box, especially, to a savings coin box in which the power releasing of said music box is controlled by said coin.

2. Description of the Prior Art

In generally, the structure of a savings coin box purely provides a space for storing coins thrown therein.

In a further design, a spring type music box is arranged within the inner space of said savings coin box. (See, for example, U.S. Pat. No. 5,509,602.)

The main components of the savings coin box described in U.S. Pat. No. 5,509,602 contains a control piece, a control rod, etc. By the throwing in of a coin to push the control rod to rotate and re-position said control rod, the potential power of said music box may be released, and when said music box is rotated through a predetermined angle, the power of said music box is locked again.

According to this prior art coin box with music box, in order to attain expected objects, the structure contains at least seven control components, therefore, the cost is increased.

Moreover, the music box within said savings coin box is arranged longitudinally, thus in some situations, for example, when said music box must be assembled transversely, said prior structure could not be used.

SUMMARY OF THE INVENTION

Accordingly, the present invention is directed at a savings coin box, wherein the music box therewithin is transversely arranged on a proper height of said cylindrical body, and a control means, containing an extending rod and a control disk, is installed above the music box. According to said structure, when the coin is being guided into said savings coin box from a guiding rail, said extending rod is driven so that the music box will not be confined and the power thereof is released. After the control disk is rotated through a predetermined angle, said music box is confined again by said extending rod and stops.

The number of components of the present invention is thus greatly reduced compared to the prior art, and thus the cost is decreased.

BRIEF DESCRIPTION OF THE DRAWINGS

The invention, as well as its many advantages, may be further understood by the following description and drawings in which.

DETAILED DESCRIPTION OF THE PREFERRED EMBODIMENT

Figure 1:
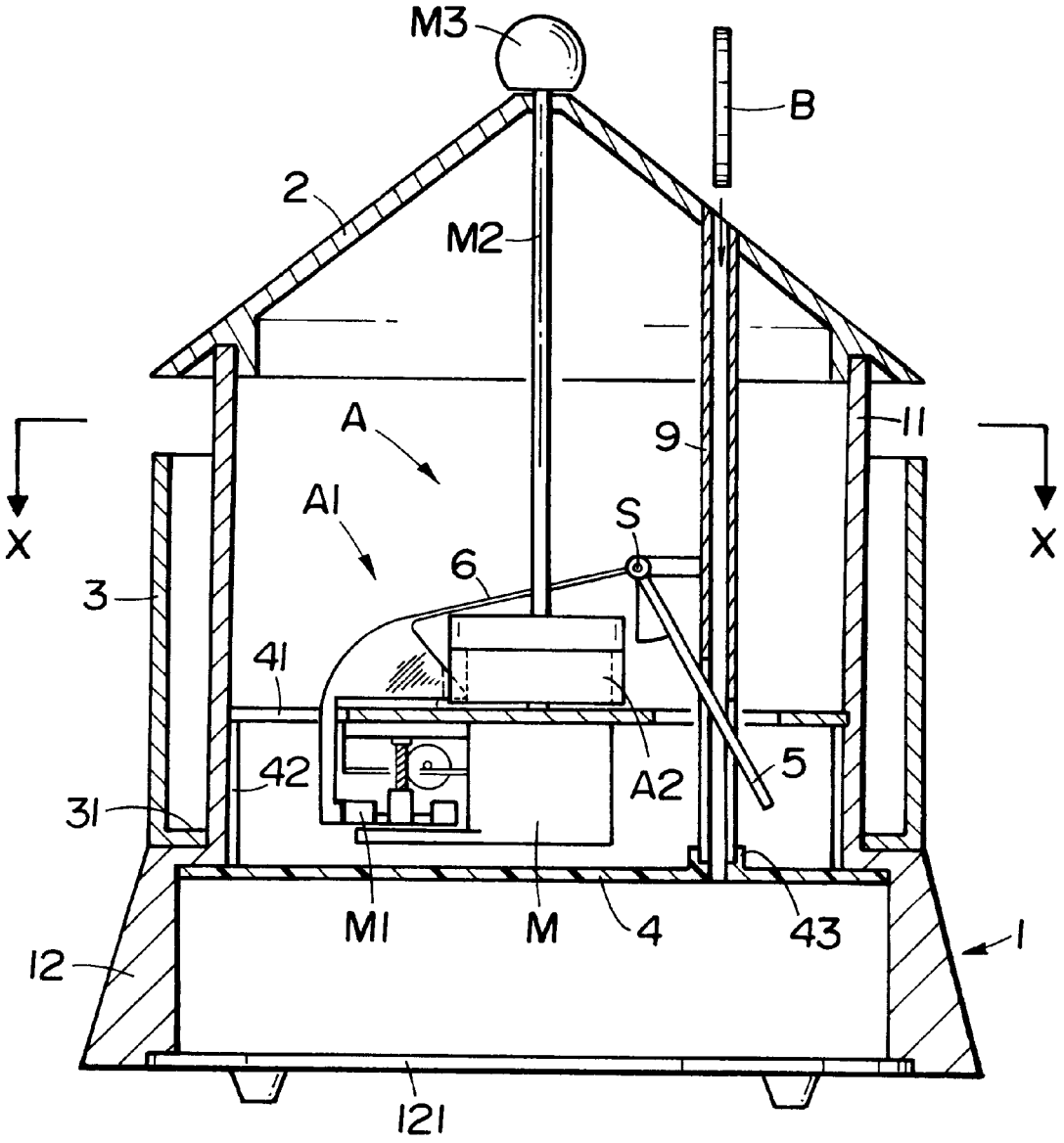
FIG. 1 is the front cross sectional view of the present invention.
Figure 2:
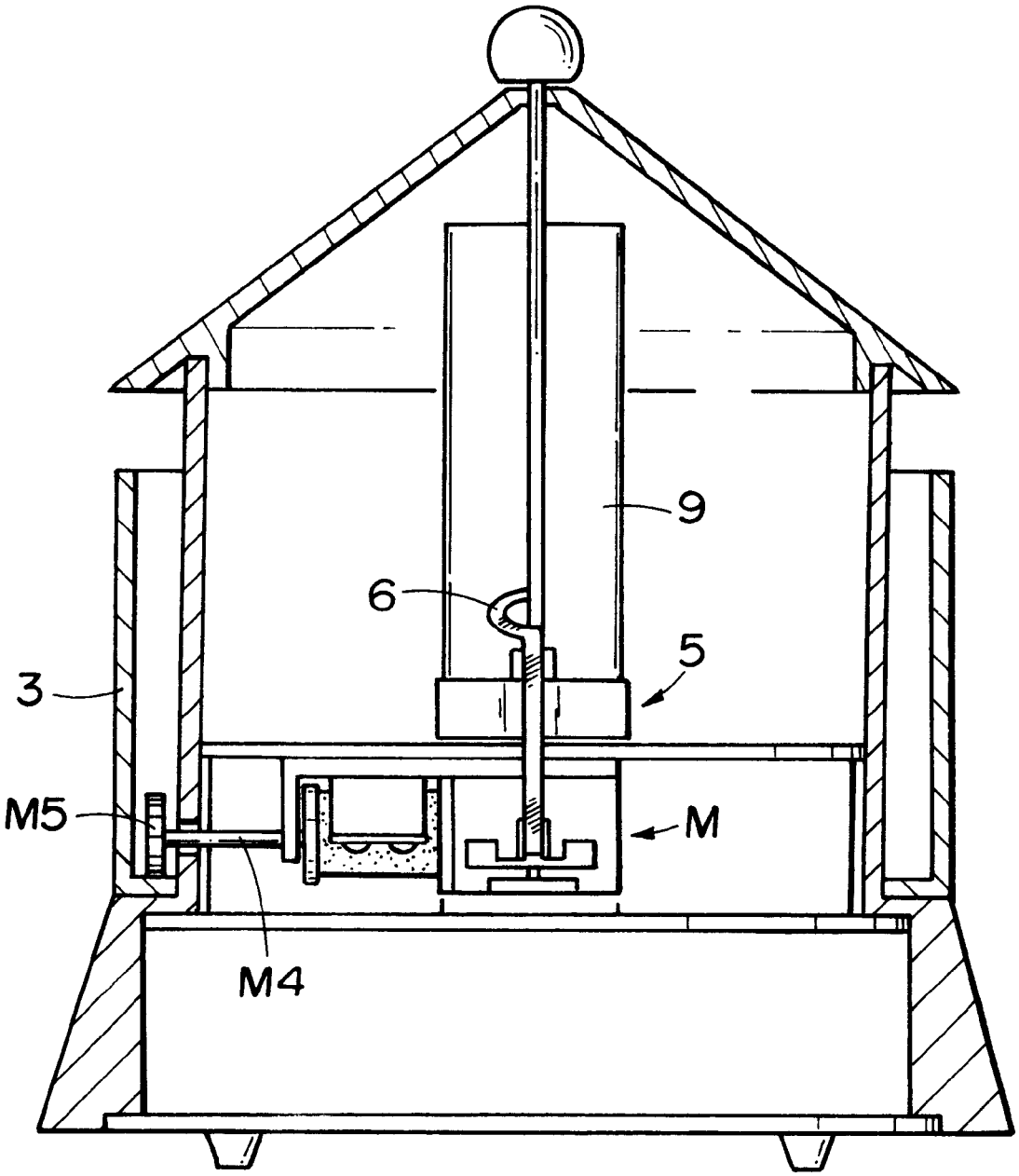
FIG. 2 is the side view of FIG. 1.
Figure 3:
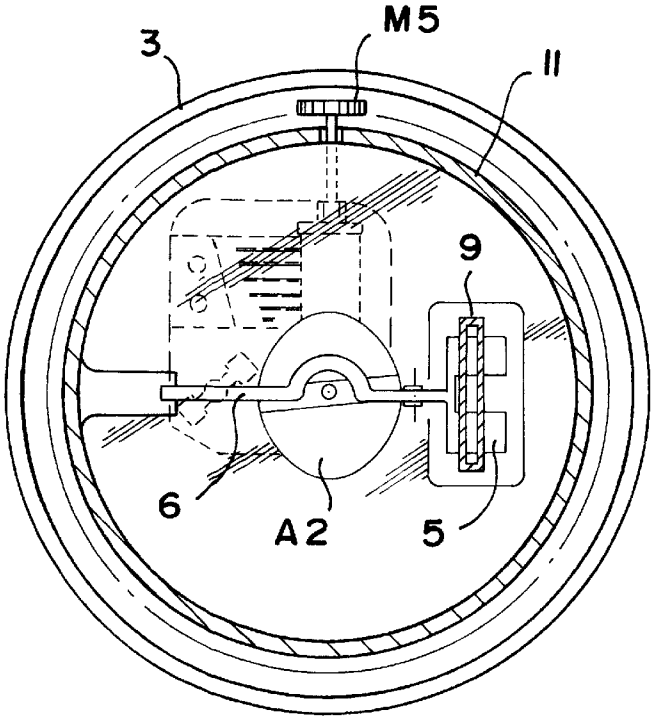
FIG. 3 is the cross section view along the line X—X of FIG. 1, which shows the relative position of a music box, an equilibrium rod, a control disk and a guiding rail.

The detailed construction of the present invention is shown in FIGS. 1, 2, and 3, which is mainly comprised of a cylindrical body 1, a music box M, a control means A, and other components.

Said cylindrical body 1 contains a cylinder (11) and a lower base (12) the diameter of which is larger than that of the cylinder (11), thus the base (12) and the cylinder (11) are formed as a ladder shape.

Moreover, a ring rotation cylinder (3) is supported on the ladder portion between said base (12) and said cylinder (11), and a ring shape rack 31 is formed inside the rotation cylinder (3).

Furthermore, said cylinder (11) is covered by an upper cover (2), said upper cover (2) thus makes the cylindrical body (1) formed as a closed space.

Further, a fixing disk (4) is installed between said base (12) and said cylinder (11), and a supporting disk (41) is installed within the cylinder (11) above the fixing disk (4), which is supported on a proper height by a longitudinal portion (42) extending from said fixing disk (4).

The lower end of said supporting disk (41) is fixedly installed with a spring type music box (M) which is used in the prior art, wherein the axle of the spring SP (schematically represented FIG. 11) (the axle center for tightening the spring) is arranged on the axial center of said cylinder (11) and an extending shaft (M 2) is installed and connected on the spring axle of said music box (M), said extending rod is passed through said upper cover (2) and the upper thereof is installed with a spanner (M3) which is used to tighten the spring of the music box (M) by the user through said extending shaft (M2) so to provide power to said spring.

Further, a fly wheel (M1) which is sued to control the power releasing speed of said spring is installed on one side of said music box (M).

Since the fixing disk (4) is used to separate said base (12) and said cylinder (11), the independent space within said base (12) may be used to save coins (B), and said saved coins (B) will not interrupt the operation of said music box (M) by human actions.

Because an output axle (M4) is installed on one side of the cylindrical dial disk of the music box, the output (M4) is extended to pass through the cylinder (11) and a driving gear (M5) is installed on the end portion thereof, while said driving gear (M5) is engaged with the ring shape rack (31) of said rotating cylinder (3). Therefore, when the power of said music box (M) is released, the rotating cylinder is driven so to rotate around the cylinder (11).

Said shape of the rotating cylinder is only one example. The shape thereof may be changed, for example, the wall surface may be changed to include shapes of animals. Then, as a whole, the present invention is formed to provide the scenery of an amusement park.

Further, a longitudinal guiding rail (9) is installed on the side of the music box (M), and said guiding rail (9) extends downward from the upper cover (2) and passes through the supporting disk (41) to the fixing disk (4). In order for said guiding rail (9) to be accurately assembled and positioned, a positioning slot (43) is installed on the respective position of said fixing disk (4) in order to engage with said guide rail (9).

Figure 6:
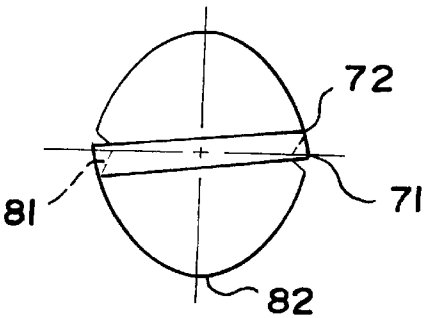
FIG. 6 is an elevational view of the control disk.
Figure 5:
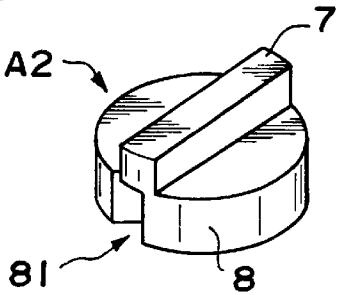
FIG. 5 is a perspective view of a control disk.

In the following, the structure of a control means (A) is described. Said control means (A) contains a equilibrium rod (A1) and a control disk (A2), wherein said control disk is fixedly installed on the extending shaft (M2) near the upper side of said music box (M). An upper flange portion (7) with proper arc and a lower flange portion (8) having grooves (81) installed on the two sides of the axle center of said control disk (A2) are shown in FIGS. 5 and 6. The first position (71) of the arc on said upper flange portion is faced to the bottom of the grooves (81) of said lower flange portion (8), and the arc portion is extended in a second direction which is reversed as compared to the rotation direction of said control disk (A2), moreover, the length of said arc is at least more than one half of the width of the groove on said lower flange portion.

Said equilibrium rod (A1) is installed above the radial direction of said control disk (A2), which is supported on the proper height according to the rotation center (S). As shown in the FIG. 4, a sensing rod (5) and an extending rod (6) are installed on the opposite sides of said rotation center (S). A stopping portion (51) is installed on said sensing rod (5) on the portion corresponding to said upper flange portion (7), and the end portion thereof is inclined so as to penetrate through coin guiding rail (9). A sustaining portion (61) and stopping portion (62) are installed on a groove portion of said extending rod (6) which is respective to the lower flange portion (8) and said flywheel portion (M1) of said music box (M), respectively.

When said equilibrium rod (A1) is assembled in a predetermined position, the rotary torque on one side of said extending rod is larger than that of sensing rod (5). Therefore, generally in the present invention, the extending rod (6) is swung downwards by gravitation force so that the sustaining portion (61) is resisted against movement by the grooves (81) of the control disk (A2). Now said stopping portion (62) is set within the rotary range of the flywheel of music box (M), and since the flywheel (M1) is locked, the power of the music box (M) can not be released.

Further, when the equilibrium rod (A1) is positioned at said locking position, the gap between the stopping portion (51) of said sensing rod and the upper fixing disk portion (7) of the control disk is set to be larger than the depth of the grooves (81) of said lower flange portion (8).

In the following, the dynamics of components and the predicted objects are described.

Figure 8:
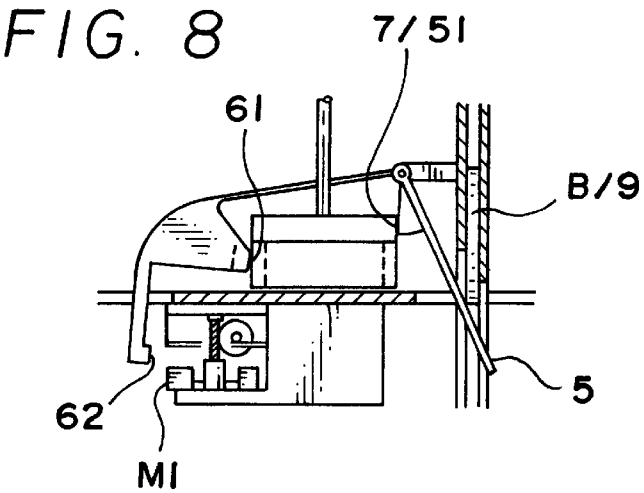
FIG. 8 is a schematic view shown the extending rod of FIG. 1 which has swung to the position shown in FIG. 7.
Figure 7:
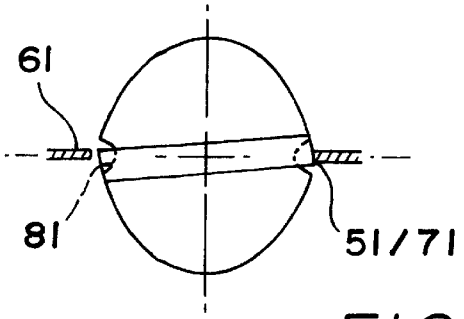
FIG. 7 is a schematic view shown that relative position of a stopping portion and the sustaining portion of an extending rod with respective control disk.

The rotary torque of the extending rod (6) is set to be larger than that of the sensing rod (5), and the difference therebetween is set to be the sum of the weight of the coins (B) and the gravitational force caused by the dropping of said coin (B). Therefore, when the coin (B) is thrown into the guiding rail (9) of said upper cover (2), said coin (B) will push the sensing rod (5) into rotation, then eventually the stopping portion (51) of the sensing rod (5) will contact with the first position (71) of the arc on the flange portion (7) of said control disk, so that the sensing rod (5) is stopped in that position, as shown in FIGS. 7 and 8. Now the free end of said sensing rod (5) is sustained within the range of said guiding rail (9), thus the thrown coin (B) is stopped by said sensing rod (5) so to stop on the guiding rail (9).

Since the gap between the stopping portion (51) of said sensing rod and the upper fixing disk portion (7) of the control disk is set to be larger than the depth of the groove (81) of said lower flange portion (8), as the sensing rod (5) is swung to said stopping portion (51) into contact with said upper flange portion (7), said extending rod (6) is also swung, respectively, so that the sustaining portion thereof will leave the range of said groove (81). Once the sustaining portion leaves the range of said groove, the flywheel of said music box (M) is also released from the limiting effect of said stopping portion (62). Therefore, the power of said music box (M) is released and beautiful music is generated, i.e., the control disk (A2) is synchronously rotated with the spring of said music box (M) according to a predetermined direction.

Figure 11:
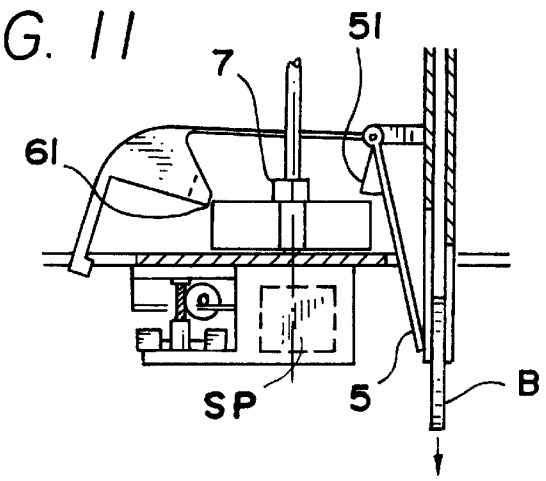
FIG. 11 is a schematic view shown that the extending rod is swung to the position of FIG. 10.
Figure 9:
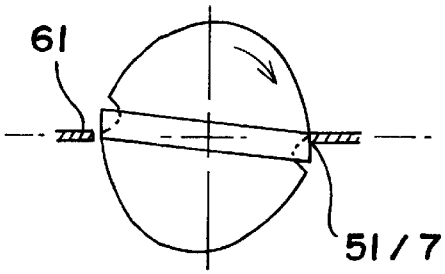
FIG. 9 is a schematic view shown that the contact point of the upper flange portion and the sensing stopping portion on the control disk of FIG. 7 is moved from a first position to a second position.

When the control disk is rotated continuously so that the stopping portion (51) is separated with the upper flange portion (7), the sensing rod further rotates inward by the compression force from the weight of said coin (B). Thus the coin (B) will pass through said sensing rod (5) and then is dropped to a space inside the base (12) from guiding rail (9), as shown in FIG. 11. Since the sensing rod (5) is no longer influenced by said coin (B), in order for the equilibrium rod (A1) to be restored to the original condition by gravitational force so that the power of the music box (M) is stopped until again released, the length of the arc on the axle of said upper fixing disk is designed to be larger than one half of the width of the grooves on the lower fixing disk. When the contacting position between the stopping portion (51) and the upper fixing disk (7) is moved from a first position to a second position, as shown in FIG. 9, said sustaining portion has left the range of said groove, therefore, after the stopping portion (51) is separated with the second position of said upper flange portion (7), the sustaining portion (61) will be supported on the periphery of said lower flange portion (8) so that the music box may release power continuously.

The control disk (A2) is continuously rotated relative to the sustaining portion (61) (said music box in a release power mode), and then the sustaining portion (61) moves into one of the grooves (81) of lower flange portion (8) such that the flywheel (M1) of said music box (M) is locked by said stopping portion (62), and then an operation process is completed.

The operation process described hereinbefore is according to the number of the grooves (81) in the lower flange portion (8) and the design of the upper flange portion (7). As shown in the embodiment of the present invention, two grooves (81) are provided on the two radial sides of the control disk to provide the illustrated arc and grooves. The extending shaft (M2) is installed in the control disk. In other words, said operation process is that the control disk (A2) rotates through 180 degrees and then is stopped, therefore, the number of grooves (81) on the lower flange portion (8) and the arc of the upper flange portion may be used to decide the rotation angle of said operation process.

The rotary difference between said extending rod (6) and the sensing rod (5) is set to be smaller than the sum of the weight of said small coin (B) and gravitation acceleration induced by the dropping of said coin (B). However, after the stopping (7) is separated with the second position (72) of said upper flange portion (7), if the weight of said coin (B) which is now stopped on the guiding rail (9) is not sufficient to push the equilibrium rod to further rotate, then said equilibrium rod (A1) could not return to the original point after an operation process has been completed.

Figure 10:
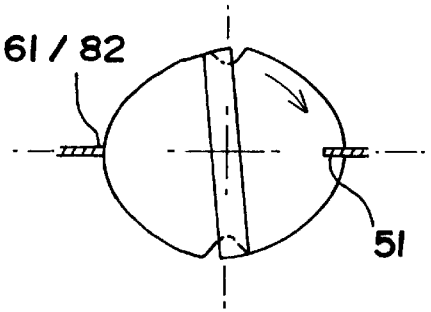
FIG. 10 is a schematic view shown that, during the rotation of the control disk in FIG. 9, the projecting portion on the lower flange portion pushes the sustaining portion of the extending rod.

In order to solve said troublesome problem during operation, therefore, a projecting portion (82) with enlarged diameter is formed on the medium portion of the rim of said lower flange portion (8). Then, when said control disk (A2) is rotated with respect to said sustaining portion (61) and retained in contact with said projecting portion (82), said extending rod is pushed and then is shifted again. Thus, the sensing rod is separated from said guiding rail (9), as shown in FIGS. 10 and 11 such that said coin (B), stopped on said guiding rail (9), will drop freely.

Figure 4:
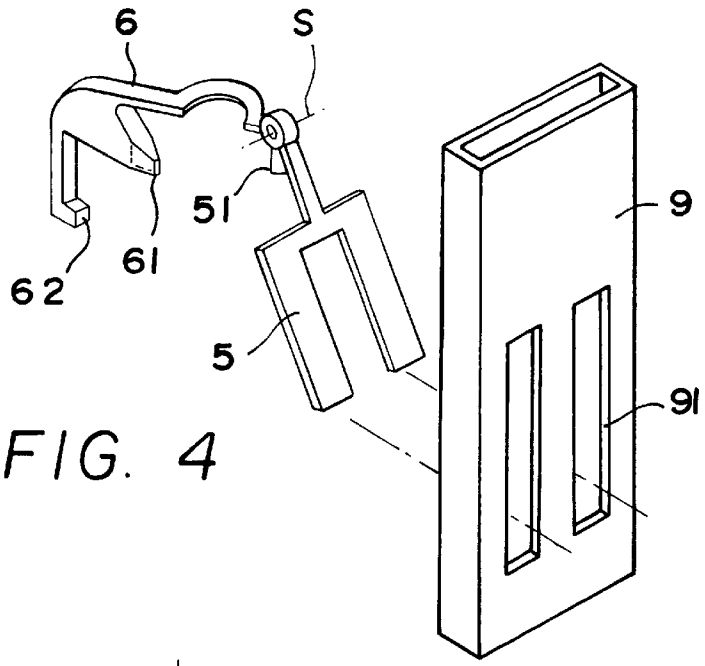
FIG. 4 is a perspective view of an equilibrium rod and a guiding rail.

Moreover, since the direction of shifting in the sensing rod (5) is set to be orthogonal to the direction of long diameter of the guiding rail (9), in order than the coin (B) thrown into the guiding rail (9) and whose diameter is smaller could be effectively pushed with the sensing rod (5), the plane width of said sensing rod (5) is larger than one half of the long length of said guiding rail (9). However, if the opening on the guiding rail (9) for the sensing rod (5) to penetrate through is too large, then the coin with small diameter could potentially lean the programming path. Accordingly, the sensing rod (5) of the present invention has a fork shape, and the opening (91) of said guiding rail (9) is respectively shaped, as shown in FIG. 4, therefore, the thrown coin (B) may be guided along the guiding rail (9).

Further, each coin (B) which is thrown from said guiding rail (9) is stored on the space of the base (B). If the coin (B) stored on the space of said base (12) is to be taken out, then an openable lower cover (121) is installed on the lower surface of said base (12), and said lower cover is designed by using a conventional technique, and is thus not defined in the present invention.

Because the power of said music box (M) is caused from a spring, after a plurality of powers releasing, the power of said spring will not be sufficient to complete the associative action. Therefore, the user may rotate a spanner (M3), through said extending rod (M2) to tighten the spring of said music box (M). The potential rotation power from tightening the spring of the music box is reversed to the direction of the power releasing. In order to prevent the sustaining portion (61) of the extending rod, in the grooves (81) of the lower flange portion (8), from disturbing the control disk wind up by the spanner (M3) the proper arc is formed on the interface of said upper groove (81) and said lower flange portion (8).

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

Description for the Numbers in FIGS.

| | |
|---|---|
| 1 cylindrical body | 2 upper cover |
| 3 rotary cylinder | 4 fixing disk |
| A control means | |
| A1 extending rod | |
| 5 sensing rod | 51 stopping disk |
| 6 extending rod | 61 sustaining portion |
| 62 stopping portion | |
| A2 control disk | |
| 7 upper flange portion | |
| 8 lower flange portion | 81 groove |
| 9 guarding rail | |

-continued

| | |
|---|---|
| B coin | |
| M music box | M1 flywheel |
| M2 extending shaft | |

I claim:

1. A savings coin box and music box combination, the combination comprising:

a coin box having a base and a body portion extending away from said base in a longitudinal direction;

a music box supported by said coin box so as to extend generally transversely to said longitudinal direction;

a coin guide rail supported by said coin box and having a section extending in a generally longitudinal direction;

a music box control assembly which is supported by said coin box and includes an equilibrium assembly having a sensing rod and an equilibrium rod which are connected and rotate about a pivot support that is positioned between said sensing rod and equilibrium rod and which defines a pivot axis that extends generally transversely to the longitudinal direction, and said sensing rod being positioned for contact with a coin traveling in said coin guide rail such that a downward rotation of said sensing rod about said pivot support causes said equilibrium rod, which extends above and at least partially across said music box, to move upward from a first position to a second position, and said equilibrium rod having a stop portion which stops play of said music box when said equilibrium rod is in said first position and allows play of the music box when in said second position, and wherein said music box control assembly includes a control disk that is pivotably supported by said coin box between radial outer ends of said sensing rod and equilibrium rod, and said sensing rod having a stopping portion and said equilibrium rod having a sustaining portion, said control disk including a lower flange portion having a pair of grooves spaced circumferentially apart from each other, said control disk further including an upper flange part having curved ends that occupy only a portion of the periphery of said lower flange portion, and said stopping portion of said equilibrium rod being positioned for contact with said upper flange part when said upper flange part is aligned with said stopping portion, and said sustaining portion being positioned within one of said grooves when said equilibrium rod is in said first position.

2. The combination of claim 1 wherein a gap between the stopping portion of said sensing rod and an arc end of said upper flange part, when said equilibrium rod is in said first position and said upper flange part is radially aligned with said sensing rod, is greater than a depth of said grooves such that, upon rotation down of the stopping portion of said sensing rod into contact with an arc end of the radially aligned upper flange part due to coin contact, said sustaining portion is released from a receiving one of said grooves to discontinue rotation blockage of said control disk.

3. The combination of claim 2 wherein said sensing rod is dimensioned so as to extend through an opening in said guide rail for coin contact and is further dimensioned so as to remain extending into said guide rail when said stopping portion is in contact with an arc end of said upper flange part.

4. The combination of claim 2 wherein said arc ends extend for a circumference that is greater than one half of that of said grooves but less than that of an outer periphery of said control disk such that upon rotation of the arc end from a radially aligned location to a location where the arc end is removed from contact with said stopping portion said stopping portion rotates further inward with respect to said control disk and said sustaining portion is positioned for riding contact with an upper section of said lower flange part.

5. The combination of claim 4 wherein said lower flange part has a projection part upon which said sustaining portion is adapted to ride, and said projection part extending sufficiently out away from a center of rotation of said control disk as to force said equilibrium rod out and up with respect to said pivot support and said sensing rod in and down with respect to said pivot support to ensure that said sensing rod is moved into a free coin passage position with respect to said guide rail.

6. The combination of claim 1 wherein said music box includes a wind up spring and said control disk is in driving connection with said spring.

7. The combination of claim 6 further comprising a shaft extending through said control disk and in the longitudinal direction away from said control disc, and said shaft having a gripping end for manual wind up of said spring.

8. A savings coin box and music box combination, the combination comprising:

a coin box having a base and a body portion extending away from said base in a longitudinal direction;

a music box supported by said coin box so as to extend generally transversely to said longitudinal direction;

a coin guide rail supported by said coin box and having a section extending in a generally longitudinal direction;

a music box control assembly which is supported by said coin box and includes an equilibrium assembly having a sensing rod and an equilibrium rod which are connected and rotate about a pivot support that is positioned between said sensing rod and equilibrium rod and which defines a pivot axis that extends generally transversely to the longitudinal direction, and said sensing rod being positioned for contact with a coin traveling in said coin guide rail such that a downward rotation of said sensing rod about said pivot support causes said equilibrium rod, which extends above and at least partially across said music box, to move upward from a first position to a second position, and said equilibrium rod having a stop portion which stops play of said music box when said equilibrium rod is in said first position and allows play of the music box when in said second position, and wherein said music box includes a spring that has a wind up axis extending in the longitudinal direction.

9. The combination of claim 8 wherein said music box further includes a flywheel that has a rotation axis extending in the longitudinal direction and said stop portion being in contact with said flywheel when said equilibrium rod is in said first position.

10. A savings coin box and music box combination, the combination comprising:

a coin box having a base and a body portion extending away from said base in a longitudinal direction;

a music box supported by said coin box so as to extend generally transversely to said longitudinal direction;

a coin guide rail supported by said coin box and having a section extending in a generally longitudinal direction;

a music box control assembly which is supported by said coin box and includes an equilibrium assembly having a sensing rod and an equilibrium rod which are connected and rotate about a pivot support that is positioned between said sensing rod and equilibrium rod and which defines a pivot axis that extends generally transversely to the longitudinal direction, and said sensing rod being positioned for contact with a coin traveling in said coin guide rail such that a downward rotation of said sensing rod about said pivot support causes said equilibrium rod, which extends above and at least partially across said music box, to move upward from a first position to a second position, and said equilibrium rod having a stop portion which stops play of said music box when said equilibrium rod is in said first position and allows play of the music box when in said second position, and wherein said sensing rod includes a two prong fork section which extends into a corresponding pair of slots formed in said guide rail.

11. A savings coin box and music box combination, the combination comprising:

a coin box having a base and a body portion extending away from said base in a longitudinal direction;

a music box supported by said coin box so as to extend generally transversely to said longitudinal direction;

a coin guide rail supported by said coin box and having a section extending in a generally longitudinal direction;

a music box control assembly which is supported by said coin box and includes an equilibrium assembly having a sensing rod and an equilibrium rod which are connected and rotate about a pivot support that is positioned between said sensing rod and equilibrium rod and which defines a pivot axis that extends generally transversely to the longitudinal direction, and said sensing rod being positioned for contact with a coin traveling in said coin guide rail such that a downward rotation of said sensing rod about said pivot support causes said equilibrium rod, which extends above and at least partially across said music box, to move upward from a first position to a second position, and said equilibrium rod having a stop portion which stops play of said music box when said equilibrium rod is in said first position and allows play of the music box when in said second position, and wherein said coin box includes an interior housing section and an exterior housing section supported by said base, and wherein said exterior housing is a cylindrical housing connected with a rotary track to which a gear of said housing driving member is in driving contact such that said exterior housing rotates with respect to said interior housing.

12. A savings coin box and music box combination, the combination comprising:

a coin box having a base and a body portion extending away from said base in a longitudinal direction;

a music box supported by said coin box so as to extend generally transversely to said longitudinal direction;

a coin guide rail supported by said coin box and having a section extending in a generally longitudinal direction;

a music box control assembly which is supported by said coin box and includes an equilibrium assembly having a sensing rod and an equilibrium rod which are connected and rotate about a pivot support that is positioned between said sensing rod and equilibrium rod and which defines a pivot axis that extends generally transversely to the lonigitudinal direction, and said sensing rod being positioned for contact with a coin traveling in said coin guide rail such that a downward rotation of said sensing rod about said pivot support causes said equilibrium rod, which extends above and at least partially across said music box, to move upward from a first position to a second position, and said equilibrium rod having a stop portion which stops play of said music box when said equilibrium rod is in said first position and allows play of the music box when in said second position, and wherein said coin box has an intermediate music box support member supported by said body portion between said base and a top of said coin box, and said music box having a top surface which is secured to an undersurface of said intermediate music box support member, said music box control assembly including a control disk in driving engagement with said music box, and said control disk being positioned for contact with said equilibrium assembly and having an undersurface supported by an upper surface of said intermediate music box support member, and wherein said coin box further comprises a fixing disk supported by said base and positioned below said music box, and said fixing disk having support means for supporting said guide rail, with said guide rail extending vertically from the top of said coin box to said support means and opening out into a coin receptacle area formed in said base and covered by said fixing disk.

13. A savings coin box and music box combination; comprising:

a coin box having a base and a coin box housing supported by said base;

a music box having a wind up spring, said music box being supported by said coin box;

a coin guide rail supported by said coin box;

music box control means for starting and stopping music box play with said music box control means being supported by said coin box, said music box being positioned transverse with respect to a vertical central axis of said coin box such that said wind up spring has a winding axis extending in a common direction to that of said vertical central axis, wherein said control means includes an equilibrium assembly supported by said coin box and having a sensing element positioned for coin contact and an equilibrium element connected with said sensing element such that motion in said sensing element causes motion in said equilibrium element between first and second positions with said first position being a music box stop play position and said second position being a music box free to play position, and said combination further comprising a control disk supported by said coin box above said music box and below said equilibrium assembly, and said control disk being in driving engagement with said spring and having means for relative positioning of said sensing element and said equilibrium element between said first and second positions.

14. The combination of claim 13 further comprising a hand wind up shaft extending along the wind up axis of said spring, through said control disk and external to said coin box.

15. A savings coin box and music box combination; comprising:

a coin box having a base and a coin box housing supported by said base;

music box having a wind up spring, said music box being supported by said coin box;

a coin guide rail supported by said coin box;

music box control means for starting and stopping music box play with said music box control means being supported by said coin box, said music box being positioned transverse with respect to a vertical central axis of said coin box such that said wind up spring has a winding axis extending in a common direction to that of said vertical central axis, wherein said control means includes an equilibrium assembly supported by said coin box and having a sensing element positioned for coin contact and an equilibrium element connected with said sensing element such that motion in said sensing element causes motion in said equilibrium element between first and second positions with said first position being a music box stop play position and said second position being a music box free to play position, and wherein said sensing element has a two prong forked rod that extends into a pair of corresponding grooves formed in said guide rail.

16. The combination of claim 15 wherein said equilibrium element and said sensing element extend out from an intermediate pivot support supported by said coin box, and said equilibrium element is weighted so as to shift out of said first position upon a coin travelling through said coin guide rail and into contact with said sensing element and to shift back said equilibrium element to said first position due alone to the relative weighting of said equilibrium element and sensing element to opposite sides of said pivot support.

17. A savings coin box and music box combination; comprising:

a coin box having a base and a coin box housing supported by said base;

a music box having a wind up spring, said music box being supported by said coin box;

a coin guide rail supported by said coin box;

music box control means for starting and stopping music box play with said music box control means being supported by said coin box, said music box being positioned transverse with respect to a vertical central axis of said coin box such that said wind up spring has a winding axis extending in a common direction to that of said vertical central axis, and wherein said coin box housing has an inner sleeve and an outer sleeve supported on said base, and said combination further comprising a driving shaft extending perpendicular to the spring axis and in driving engagement at one end with said music box and at an opposite end to one of said sleeves.

* * * * *